US010400391B2

(12) United States Patent
Cardinali et al.

(10) Patent No.: US 10,400,391 B2
(45) Date of Patent: Sep. 3, 2019

(54) PROCESS FOR THE PREPARATION OF A NON-WOVEN MICROFIBROUS SUEDE-LIKE SYNTHETIC FABRIC

(71) Applicant: ALCANTARA S.P.A., Milan (IT)

(72) Inventors: Walter Cardinali, Marsciano (IT); Gianni Romani, Terni (IT); Paolo Armadori, Acquasparta (IT); Giovanni Palomba, Terni (IT); David Zoppitelli, Terni (IT)

(73) Assignee: ALCANTAEA S.P.A., Milan (IT)

( * ) Notice: Subject to any disclaimer, the term of this patent is extended or adjusted under 35 U.S.C. 154(b) by 648 days.

(21) Appl. No.: 14/437,313

(22) PCT Filed: Oct. 21, 2013

(86) PCT No.: PCT/IB2013/059498

§ 371 (c)(1),
(2) Date: Apr. 21, 2015

(87) PCT Pub. No.: WO2014/087271

PCT Pub. Date: Jun. 12, 2014

(65) Prior Publication Data

US 2015/0275421 A1 Oct. 1, 2015

(30) Foreign Application Priority Data

Oct. 22, 2012 (IT) ..... MI2012A1780

(51) Int. Cl.
*D06N 3/00* (2006.01)
*D06N 3/14* (2006.01)

(52) U.S. Cl.
CPC ..... *D06N 3/0004* (2013.01); *D06N 3/004* (2013.01); *D06N 3/0011* (2013.01); *D06N 3/14* (2013.01);

(Continued)

(58) Field of Classification Search
USPC ..... 428/91, 297.4; 442/102, 164, 168
See application file for complete search history.

(56) References Cited

U.S. PATENT DOCUMENTS 3,531,368 A 9/1970 Okamoto et al.
3,532,368 A 10/1970 Stuart
(Continued)

FOREIGN PATENT DOCUMENTS

CN 1453421 A 11/2003
CN 1651644 S 8/2005
(Continued)

OTHER PUBLICATIONS

Database WPI, Week 200414, Jun. 25, 2013 (Jun. 25, 2013), Thomson Scientific, London, GB; AN 2004-136024, XP002699444.

*Primary Examiner* — Lynda Salvatore
(74) *Attorney, Agent, or Firm* — Pearne & Gordon LLP

(57) ABSTRACT

The present invention refers to a process for the preparation of a non-woven microfibrous suede-like synthetic fabric that does not require the use of organic solvents and that makes it possible to obtain a finished product offering a good hand, excellent resistance to yellowing and high durability. It comprises needle-punching a felt of sea/island fibers, (a) impregnation with hot aqueous solution of PVOH having a degree of saponification of at least 94% or (b) impregnation with hot water followed by impregnation with cold PUR, removing the sea component, impregnating with PUR, coagulating the PUR, removing the PVOH, grinding the surface, dyeing and splitting in two sheets.

20 Claims, 2 Drawing Sheets

(52) U.S. Cl.
CPC ... *D06N 2205/023* (2013.01); *D06N 2205/24* (2013.01); *D06N 2211/28* (2013.01); *Y10T 428/2395* (2015.04)

(56) References Cited

U.S. PATENT DOCUMENTS

| | | | | |
|---|---|---|---|---|
| 3,889,292 | A | 6/1975 | Bocek | |
| 6,890,602 | B2 * | 5/2005 | Romani | C08G 18/0819 427/412 |
| 6,921,508 | B2 * | 7/2005 | Latini | D06N 3/0004 264/172.13 |
| 7,998,887 | B2 | 8/2011 | Horiguchi et al. | |
| 2003/0017773 | A1 | 1/2003 | Latini et al. | |
| 2004/0006857 | A1 | 1/2004 | Romani | |
| 2006/0234587 | A1 | 10/2006 | Horiguchi et al. | |

FOREIGN PATENT DOCUMENTS

| | | | |
|---|---|---|---|
| CN | 101701425 | A | 5/2010 |
| CN | 101798763 | A | 8/2010 |
| CN | 102619095 | A | 8/2012 |
| EP | 1 243 691 | A1 | 9/2002 |
| EP | 1 353 006 | A1 | 10/2003 |
| JP | 2003-089985 | A | 3/2003 |

* cited by examiner

PROCESS FOR THE PREPARATION OF A NON-WOVEN MICROFIBROUS SUEDE-LIKE SYNTHETIC FABRIC

The present invention refers to a process for the preparation of a non-woven microfibrous suede-like synthetic fabric, a process that does not require the use of organic solvents and that makes it possible to obtain a finished product offering a good hand, excellent resistance to yellowing and high durability.

There are known processes in the prior art for the preparation of non-woven microfibrous suede-like fabrics obtained from so-called "island-in-the-sea" fibres. In accordance with this technology, a bicomponent fibre is prepared, said bicomponent fibre being constituted by a component of the "island" type, completely surrounded by the other "sea" component. Said fibre is obtained by feeding the two polymeric components to a spinneret and processed using methods known in the art (see for example U.S. Pat. Nos. 3,532,368, 3,889,292 and 3,531,368). Generally, the fibre thus obtained is then utilized for the preparation of a felt by means of needle punching, which is then subjected to various steps of impregnation with aqueous solutions and an organic solvent, for the fixing and/or removal of the various components. For the preparation of non-woven fabrics having a suede-like appearance, the felt obtained by needle punching generally undergoes a first impregnation with an aqueous solution of polyvinyl alcohol (PVA), followed by dissolution of the "sea" component, for example in trichloroethylene. The resulting microfibrous intermediate product is again impregnated with a solution of polyurethane (PU) in an organic solvent (such as DMF for example). Lastly, after one or more finishing treatments, the PVA is eliminated and the product thus obtained undergoes the finishing treatment that comprises the "splitting" step, followed by immersing and dyeing, respectively.

There are also known processes of the prior art for the preparation of a non-woven fabric in which both impregnation steps are carried out in PU, in the form of an aqueous solution or organic solvent (see for example EP1353006).

There has recently been developed a process for the preparation of a non-woven fabric that comprises the formation of the island-in-the-sea fibre, followed by impregnation with PVA and PU, without the use of organic solvents (see EP1243691). Although the use of water in place of the commonly used organic solvents (such as DMF and trichloroethylene for example) represents a significant advantage economically and in terms of the environment, and although it is possible to obtain a finished product that is capable of maintaining the desired characteristics relating to the hand and resistance, there is still a need to find a process that makes it possible to realize a non-woven fabric offering excellent resistance to yellowing and high durability, with a good hand, and that is realized with methods characterized by low environmental impact or environmentally-friendly methods and with low production costs. Yet, the process described comprises the utilization of some substances that are potentially hazardous to health, including boric acid for example. Moreover, process variability related to the partial solubility of the PVA complexed with boric acid under conditions of dissolution of the sea component, can constitute an aspect that can lead to a decrease in the efficiency of the process in general.

The Applicant has now found a process for the preparation of a microfibrous non-woven material that permits the use of water as a solvent, obtaining a fabric offering excellent resistance and hand, improved dyeing resistance with the resulting possibility of producing very thin materials, also having high durability and resistance to yellowing.

Therefore, in a first aspect, the present invention refers to a process for the preparation of a non-woven microfibrous fabric, comprising the steps of:

a. preparing a felt via needle punching of a bicomponent fibre of the "island-in-the-sea" type,
b. hot impregnation of said felt with an aqueous solution of polyvinyl alcohol (PVA) having a degree of saponification of at least 94%, or hot impregnation of said felt with water and then cold impregnation with polyurethane (PU),
c. removal of the sea component from the intermediate product of step b,
d. impregnation of the microfibrous intermediate product with PU,
e. fixing the PU to the microfibrous intermediate product by means of coagulation and removing the PVA possibly added in step b,
f. submitting the material thus obtained to immersing on one or both sides, dyeing and splitting, preferably carried out in the order specified.

The material produced according to the present process can be emersed further on the side in contact with the blade, in the case that it is necessary to increase or modify the contact surface for further post-processing procedures, including for example gluing to fabric backings, coating with resins and fireproofing, and/or to reduce the thickness even further.

In a further aspect, the invention refers to a non-woven microfibrous suede-like synthetic fabric obtained (or obtainable) with the present process.

Further characteristics and advantages of the invention will be illustrated below, with reference to the attached figures, in which.

Figure 1:
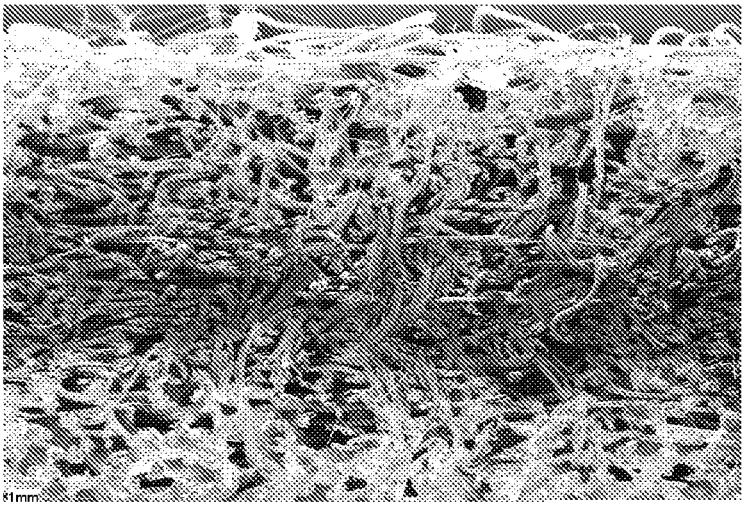
FIG. 1 is a section of a microfibrous intermediate product impregnated with an aqueous solution of PVA with a high degree of saponification, the product being obtained after removal of the sea component from the dried felt (that is, after step c). The distribution of PVA is most evident at the edges.
Figure 2:
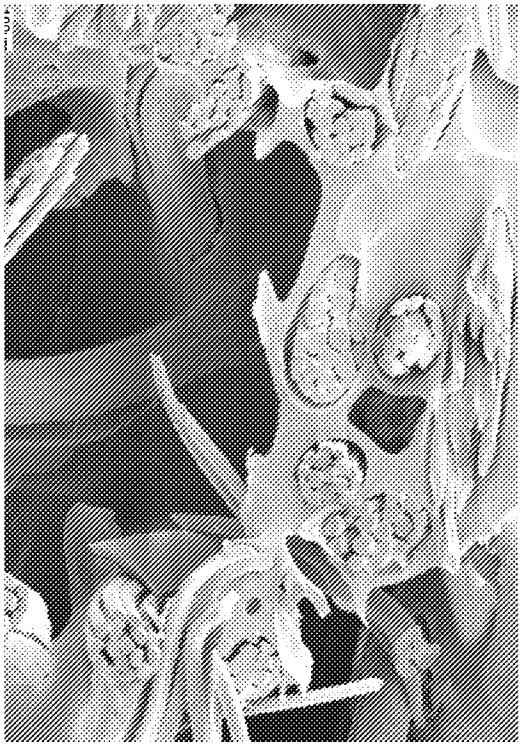
FIG. 2 represents a detail of the microfibrous intermediate product impregnated with an aqueous solution of PVA with a high degree of saponification, appearing in FIG. 1, the product being obtained after removal of the sea component from the dried felt (after step c), and wherein the microfibrous islands of PET freed from the sea component following the dissolution thereof are clearly evident.

More specifically, in the process of the present invention, the preparation of the felt according to step a takes place by needle punching a bicomponent fibre of the "island-in-the-sea" type. The latter can be obtained according to techniques known in the art, which comprise the feeding of two pure polymers or two mixtures of polymers to a spinneret so that one of the two polymeric ("sea") components completely surrounds the other component constituted by various polymeric filaments that form the various "islands". In this regard, the island component can be selected from among: modified polyesters, cationic polyesters, nylon or other types of polyamides, polyethylene, polypropylene, polymethylene terephthalate (PTT), polybutylene terephthalate (PBT) and polyethylene terephthalate (PET), the latter being particularly preferred.

An example of a sea component is instead represented by a spinnable polymer, preferably selected from among: polyvinyl alcohol (PVA), polystyrene copolymers containing PVA (co-PVA-PS), copolyesters containing PVA (co-PVA-PES) and copolyester containing 5-sulfoisophthalic acid or the sodium salt thereof (co-PES), the latter being particularly preferred.

Both the sea and island components can be used in a mixture with added components selected from among inorganic pigments for the island component, and incompatible polymers for the sea component which facilitate breakage of the sheath during the steps for drawing and production of the intermediate felt product. In a particularly preferred embodiment, the felt as per step a is obtained via the needle punching of a bicomponent fibre made up of PET and Co-PES possibly mixed with inorganic pigments in the island component and with incompatible polymers in the sea component.

The bicomponent fibre has a ratio between the island component and the sea component that is such as to enable spinning of the two components by means of a spinneret rapidly and efficiently. Said island/sea ratio is preferably within the range of 20/80 and of 80/20, more preferably within the range of 50/50 and of 80/20. Prior to the needle punching process, the bicomponent fibre is usually treated according to known methods of the prior art, which comprise stages in lubricants and drawing so as to improve the orientation of the macromolecules in the drawing direction and the physical and mechanical properties, in addition to decreasing the titre of the fibre thus obtained—this latter characteristic being particularly required for the production of products of fine quality. In a preferred embodiment of the invention, prior to being drawn, the fibre has a titre in the range of 6.5 to 19.4 dtex, preferably in the range of 9.2 to 17 dtex. Moreover, drawing is carried out with ratios generally varying in the range of 2-5, preferably in the range of 2.1-3.9. At the end of step a, a felt is obtained of a thickness preferably ranging between 2 and 4 mm, and it has an apparent density ranging between 0.1 and 0.5 g/cm$^3$, more preferably ranging between 0.15 and 0.3 g/cm$^3$. Advantageously, at the conditions of the process, said density and thickness values prove to be optimal for obtaining a final non-woven product offering a good hand, softness, appearance and mechanical strength.

The felt obtained following step a is then impregnated as per step b of the present process. In practice, the step of impregnating the felt can take place by means of contact of the latter with a hot aqueous solution of PVA having the characteristic of becoming only slightly soluble under the conditions of removal of the sea component, once it has dried and been treated at high temperature. Alternatively, step b can take place by means of hot water shrinkage, and subsequent cold impregnation with PU in an aqueous medium. In this latter case, following hot water shrinkage, the felt preferably undergoes a drying stage, followed by subsequent cold impregnation with PU in an aqueous medium. Unless specified otherwise, "hot water shrinkage" is intended as a step of immersion in water at a temperature of at least 50° C., preferably ranging between 60 and 99° C. "Cold impregnation" is intended to indicate an impregnation temperature no higher than 50° C., more preferably within the range of 15 to 40° C. In both cases, impregnation can be realized by means of known techniques of the prior art, including for example, immersion and metering by means of squeeze rolls. Hot impregnation of the felt with water or a solution of PVA takes place at a temperature of at least 50° C., preferably within the range of 60 to 99° C., so as to achieve dimensional stabilization of the intermediate product owing to the release of the tensions accumulated with the spinning, drawing and felting process. Dimensional stabilization also generally produces an increase in density with a resulting improvement of the aesthetic characteristics of the final product obtained. In particular, the PVA utilized in step b is characterized in that it has a solubility in water, or in aqueous solvents, which is markedly lower than the solubility of the "sea" component of the bicomponent fibre under the dissolution conditions. For this purpose, the present process comprises the use of a PVA with a high degree of saponification, that is, of at least 94%, even more preferably of over 97%. Said degree of saponification enables the PVA to be insoluble in an aqueous medium, this insolubility being such as to resist the subsequent treatment for removal of the sea component, without jeopardizing the dissolution thereof in water following step e of the process as described herein below. Advantageously, the use of PVA having said degree of saponification permits the realization of step b without employing any cross-linking agents, as is instead the case in the prior art, including for example boric acid or compounds of vanadium or zirconium, which are potentially harmful to health.

The solubility of the PVA can also be adjusted after impregnation step b, by means of high-temperature thermal treatments. In this regard, the felt impregnated with PVA is treated after drying at a temperature ranging between 150° C. approximately and 250° C. approximately, for example through the use of ovens, jets of air or infrared radiation, for a period that can vary from less than one minute to about 15 minutes, typically depending on the temperature utilized, the required degree of resistance to dissolution and the degree of saponification.

In the case in which step b is carried out by impregnation of the felt with PU, the latter is preferably selected from among the formulations of polyurethane in an aqueous medium, for example in the form of an emulsion or aqueous dispersion. The polyurethane thus mixed can be fixed by means of hot-air coagulation, in a solution containing acids, in aqueous solutions containing electrolytes, by radiofrequency, microwave and steam coagulation. As is known, PU is a polymer that has a polymeric chain made up of urethane bonds only (that is, —NH—(CO)—O—) or a mixture of urethane and urea bonds (that is, —NH—(CO)—NH—), and it is prepared by reaction between a polyol and a diisocyanate. In the present invention, the PU is preferably obtained by reaction of an aliphatic or aromatic diisocyanate with polyols of a mean molecular weight ranging between 500 and 5000 Da, even more preferably selected from among: polyether, polyester, polycarbonate and a polyester-polycarbonate blend.

In one embodiment, step b can take place in the presence of further additives, including for example thickeners, surfactants, viscosity regulators in general, salts of alkali metals or of alkaline earth metals such as $CaCl_2$ and the like, and silicone derivatives. At the end of the impregnation step, the felt impregnated with PVA or PU usually undergoes a step for thermo-fixing (curing) of the PVA or PU, which takes place by means of thermal treatment at a temperature of at least 90° C., preferably ranging between 150 and 250° C., even more preferably ranging between 180 and 220° C. Said treatment can take place using ovens, according to known methods of the prior art. In this manner, it is possible to stably fix the PVA or PU to the felt, thereby making it possible to carry out the next step for removal of the "sea" component, without substantially modifying the PVA or PU content in the material.

In this regard, step c for removal of the "sea" component takes place by means of contact of the felt impregnated with PVA or PU, as obtained previously in step b, with a basic aqueous solution of alkaline hydroxide or alkaline earth, preferably NaOH. Said contact takes place preferably by immersion (washing) of the felt impregnated with PVA or PU in the selected basic aqueous solution, which can also be followed by repeated washing with water, for the purpose of ensuring the elimination of possible residues of the basic solution on the sample that could cause partial and undesired dissolution of the "island" component. Preferably, the pH level of this solution is at least 8, and preferably within the range of 10 to 14. In one embodiment, the concentration of the basic solution ranges between 1 and 48%, preferably between 5 and 15%. The removal of the "sea" component as per step c, takes place at a temperature and for a period of time that are selected so as to optimize the selective dissolution of this component, dissolving the least possible amount of PVA or PU applied, while also avoiding degradation of the microfibre of the "island" component. To achieve more efficient removal and shorter time periods, the temperature of the basic solution is preferably at least 40° C., more preferably at least 60° C., even more preferably within the range of 65° C. to 90° C., if the impregnation stage b is carried out using a PU. In the case in which step b is carried out with PVA, the temperature during the removal step is preferably lower than 80° C., more preferably lower than or equal to 70° C. The microfibrous intermediate product deprived of the "sea" component is then submitted to step d for impregnation with PU. In particular, the latter can be present in an aqueous medium, for example in emulsions or aqueous dispersions, or even in an organic medium, for example in a solution with polar organic solvents. The concentration of the impregnation solution preferably ranges between 10 and 40%, more preferably between 15 and 30%. Concentrations greater than 30% could prove to be particularly viscous and difficult to impregnate (especially for solvent-based polyurethanes), while concentrations lower than 10% could cause poor stability of the PU dispersion over time and markedly modify the structure of the coagulated polyurethane and the type of adhesion between the polyurethane and the microfibre to the point of jeopardizing the resistance of the intermediate product during the dyeing process. In a manner similar to step b of the present process, impregnation with PU as per step d typically takes place by means of immersion and metering with squeeze rolls or by means of known techniques of the prior art (for example, waves of pressure). Preferably, the microfibrous intermediate product is impregnated with the PU by immersion and metering with squeeze rolls.

In the case of impregnation with PU in an aqueous medium, this can be conveniently performed using a so-called self-emulsifying polyurethane polymer, and/or by adding suitable external emulsifiers, such as ionic and non-ionic surfactants for example. Preferably, the emulsifiers are employed at concentrations ranging between 0.5 and 10% with respect to the PU. With the aim of obtaining the desired mechanical characteristics and the desired resistance to solvents, in step d the impregnation can take place in the presence of a cross-linking agent that is preferably capable of activation during the drying stage of the PU at a temperature in the range of 100° C. approximately to 200° C., preferably in the range of 110° C. approximately to 160° C. Said cross-linking agent is preferably utilized in an amount ranging between 0.5 and 10%, and it may be selected from among: melamines, aziridines, carbodiimides, epoxides, zirconium compounds, isocyanate derivatives or preferably, blocked isocyanate with a low unblocking temperature. Furthermore, impregnation with PU can take place in the presence of further additives including, for example, thickeners, surfactants, viscosity regulators in general, destabilizing agents, salts of alkali metals or of alkaline earth metals and silicone derivatives, preferably in amounts ranging between 0 and 10%, more preferably ranging between 0 and 5%, with respect to the PU. $CaCl_2$ is an example of an alkaline salt and it is used to facilitate the destabilization of the dispersion of polyurethane with an increase in the temperature (PUs capable of thermal coagulation), whether it is found in the core of the dispersion, or outside, dissolved in the coagulation solution (coagulation T ranging between 20 and 90° C.).

In the case in which step d is conducted in an organic medium, the PU is generally dissolved in a polar organic solvent, preferably selected from among dimethylacetamide (DMAC) and dimethylformamide (DMF), the latter being particularly preferred. Furthermore, when impregnation is carried out in an organic medium, the subsequent curing step e is carried out by means of coagulation in water or in a water/solvent mixture. In particular, coagulation of the microfibrous intermediate product impregnated with PU, in an organic solution generally takes place by means of immersion of the microfibrous intermediate product in a water bath, possibly in the presence of DMF, preferably with a ratio of DMF/$H_2O$ ranging from 0/100 up to 50/50 by weight. The coagulation temperature ranges between 20 and 50° C., preferably between 25 and 40° C., depending on the amount of DMF that may be present in the coagulation water bath. To improve adhesion of the microfibre to the polyurethane, it may be necessary to add wetters to the solution of polyurethane in an organic solvent or submit the intermediate product obtained with step c to treatment with wetting agents or agents for neutralizing the surface charge of the microfibre before proceeding with impregnation with the above-mentioned polyurethane in an organic solvent. In this regard, the wetting agents that can be utilized can be selected from among the soaps, the salts of alkali metals or of alkaline earth metals or the compounds commonly utilized in the art for this purpose, and known to persons skilled in this field.

Following impregnation step d, the microfibrous intermediate product is submitted to step e for the curing of the PU. In the case in which the preceding step d has taken place in an aqueous medium, curing can take place by means of: hot air coagulation, hot water coagulation, in an aqueous solution of electrolytes, radiofrequency coagulation, microwave coagulation, steam coagulation, or even by acid coagulation. Coagulation preferably takes place by air, hot water or radiofrequency coagulation. In the event of coagulation in an aqueous solution containing dissolved electrolytes, coagulation of the polyurethane can be achieved at a low temperature (that is, at a temperature no higher than 50° C.), leading to considerable energy savings. In the case of radiofrequency or hot air coagulation, however, it is possible to achieve the curing of the PU thermally without necessarily reaching complete drying of the impregnated intermediate product, leading to considerable savings as regards energy and initial investment costs, if the treatment is combined with types of polyurethane dispersed in water and capable of thermal coagulation.

In the case of hot air coagulation, the material obtained after step d is set in contact with the air at a temperature ranging between 50° C. approximately and 200° C. approximately, preferably ranging between 60° C. approximately and 160° C. approximately, so as to afford better control over the migration of the polyurethane during the heating period; the duration of the heating period can vary, for example based on the type of polyurethane being utilized, in that in the case of the use of polyurethanes that are capable of thermal coagulation, it is possible to limit the heating period, thereby avoiding complete drying and thus economizing on the amount of energy required for evaporation of the water that is present. Preferably, the PU is coagulated on the microfibrous intermediate product in an oven, preferably a pin oven, at increasing temperatures ranging between 60° C. and 160° C. Said temperature gradient prevents the water from evaporating so rapidly that even the solid part of the dispersion is transported towards the surface, before it receives sufficient heat to break down the surfactants that keep the PU in suspension. The hot air coagulation as described herein advantageously makes it possible to obtain a finished product that offers optimal resistance and durability. Moreover, with hot air coagulation, the PU tends to become transparent, thus making any specking phenomena less evident.

In the case of hot water coagulation, however, the impregnated material obtained after step d is set in contact, preferably by immersion, with water at a temperature ranging between 20° C. approximately and 90° C., preferably ranging between 40° C. approximately and 80° C. The water generally consists of deionized or softened water, and it can also contain a certain amount of an agent for destabilizing the dispersion of PU and that makes it possible to lower the temperature at which the PU begins to coagulate (also defined by the term "cloud point").

One example of a destabilizing agent consists of calcium halides, preferably $CaCl_2$. The selected agent can be utilized in amounts ranging between 0.01% and 5% by weight, more preferably ranging between 0.1% and 1%. Hot water coagulation is particularly convenient when improved softness of the final product is desired.

Moreover, in a preferred embodiment of the invention, to minimize polyurethane migration during the coagulation process and/or to minimize the loss of polyurethane in the coagulation tank, a thickening agent capable of increasing the viscosity of the preparation containing the PU is also added to the same preparation. The thickener is preferably of an associative type, that is, a thickener capable of associating with the PU present in an aqueous dispersion already in the form of micelles and thus producing more complex dispersed structures in which the micelles aggregate with each other. The functioning of these associative systems is well known to persons skilled in this field.

In the case of radiofrequency coagulation, the impregnated material obtained in step d of the present process is submitted to treatment by radiofrequency irradiation, for example by means of the use of a radiofrequency oven with a parallel, oblique or vertical field and to which voltage ranging between 0.1 kV and 10 kV is applied between the electrodes, preferably an oven with an oblique or parallel field with a voltage between the electrodes ranging between 0.1 and 6 kV, even more preferably an oven with a parallel field with a voltage between the electrodes ranging between 0.3 and 5 kV. Advantageously, radiofrequency coagulation makes it possible to achieve the curing of the PU in very short periods of time (even on the order of several minutes), without the need to bring the material to a completely dry state and thereby limiting phenomena causing migration of the polyurethane towards the surface of the material during the drying of the intermediate product until coagulation has taken place. In fact, even if the material exhibits residual moisture upon exiting the radiofrequency oven, complete coagulation of the PU has taken place, thereby leading to considerable advantages in terms of saving both energy and time, in addition to a qualitatively better appearance of the final product.

Upon completion of the coagulation procedure as described hereinabove, the material obtained undergoes finishing step f which yields the non-woven suede-like fabric of the invention. Specifically, the material undergoes the immersing, dyeing and splitting procedures, preferably carried out in the order specified. In one embodiment of the invention, step f of the present process can also be carried out varying the order of the immersing, dyeing and splitting procedures.

In the case in which the impregnation as per step b has taken place utilizing an aqueous solution of PVA with a high degree of saponification, as described hereinabove, prior to the finishing step the material undergoes treatment with hot water at a temperature ranging between 80 and 99° C. for removal of excess PVA.

In the case in which the impregnation as per the previous step b has taken place utilizing an aqueous solution of PU, the material is preferably dried prior to finishing.

In the case of materials that are thin in thickness, in particular, the finishing step is characterized in that the splitting of the microfibrous intermediate material impregnated with PU is carried out as the final procedure after the immersing and the dyeing of the fabric. With respect to known finishing methods of the prior art (which comprise the splitting stage as the initial stage, followed by immersing and dyeing), in the present process it is possible to carry out the dyeing procedure with an intermediate product that is thicker and more resistant to breakage. Shifting the splitting step downstream of the dyeing process is a measure that not only leads to considerable savings in terms of time, energy and utilities, but also to the realization of materials that are very thin in final thickness, without this jeopardizing the resistance of the product to the dyeing cycle.

The dyed intermediate product thus produced, containing a polyurethane that has ionic groups in the chain, can also be submitted to a second dyeing cycle with specific dyes, including for example cationic, anionic, sulphur-based, vat or reactive dyes, thereby achieving the dyeing of the polyurethane elastomer matrix as well.

Lastly, in a further aspect the invention refers to a non-woven suede-like synthetic fabric obtained (or obtainable) with the present process. Advantageously, the non-woven fabric that can be obtained with the present process demonstrates marked resistance to yellowing, a good hand and high durability, thus proving to be particularly suitable for dyeing with light-coloured dyes, such as white for example. Furthermore, owing to the finishing procedures carried out as described hereinabove, the process of the invention makes it possible to obtain a final non-woven fabric that can be of a thickness of even less than 0.7 mm, thus making it highly versatile and utilizable in various practical applications. Lastly, owing to the use of polyurethanes with ionic groups in the chain, the non-woven fabric that is obtainable with the present process can be dyed also in the polyurethane elastomer matrix.

The invention shall now be described in the following experimental section, which, however, is not intended to limit the scope thereof.

EXPERIMENTAL SECTION

Example 0

Preparation of a Felt Comprising a Bicomponent Fibre

Example 0.1

Realization of a Felt Having a Co-PES+PEG Sea Component and a PET Island Component Flock is prepared starting from a bicomponent fibre of the island-in-the-sea type, in which the island component is realized in PET and the sea component is realized in Co-PES. PEG is co-extruded in the sea component. The ratio between the island component and the sea component in the fibre is 57/43. The sea component is, in turn, constituted by 3.5% PEG and the remaining 96.5% by Co-PES. The section of the fibre reveals 16 PET microfilaments of circular shape and equal diameter. The flock is obtained by means of the successive procedures of drawing, crimping and cutting of the continuous island/sea fibre.

The characteristics of the flock are:
fibre count 4.3 dtex
length 51 mm
curling frequency 4/cm, approximately
drawing ratio 3.5/1

The flock thus defined undergoes mechanical needle punching for the realization of a felt having a density of 0.295 g/cm$^3$ and a unit weight of 1000 g/m$^2$. The felt thus obtained is identified by the name "felt F1".

Example 0.2

Realization of a Felt Having a Co-PES Sea Component and a PET Island Component Flock is prepared starting from a bicomponent fibre of the island-in-the-sea type, in which the island component is realized in PET and the sea component is realized in Co-PES. The ratio between the island component and the sea component in the fibre is 57/43. The section of the fibre reveals 16 PET microfilaments of circular shape and equal diameter. The flock is obtained by means of the successive procedures of drawing, crimping and cutting of the continuous island/sea fibre.

The characteristics of the flock are:
titre 4.3 dtex
length 51 mm
curling frequency 4/cm, approximately
drawing ratio 2.5/1

The flock thus defined undergoes mechanical needle punching for the realization of a felt having a density of 0.285 g/cm$^3$ and a unit weight of 892 g/m$^2$, and it is identified by the name "felt F2".

Example 0.3

Realization of a Felt Having a Co-PES+PVA Sea Component and a PET Island Component Flock is prepared starting from a bicomponent fibre, as described in example 0.1, substituting the PEG with previously dried PVA 5-88. The fibre has the same sea/island ratio and the same amount of additive by weight in the sea component. This flock still preserves characteristics of workability such as to enable the realization of a felt of a density of 0.304 g/cm$^3$ and a unitary weight of 1084 g/m$^2$, and it is identified by the name "felt F3"

Example 0.4

Realization of a Felt Having a Co-PES Sea Component, a PET Island Component and Thin Thickness Flock is prepared starting from a bicomponent fibre, as described in example 0.2. With this flock, a felt of a density of 0.292 g/cm$^3$ and a unitary weight of 585 g/m$^2$ is realized and it is identified by the name "felt F4"

Example 1

Preparation of a Non-Woven Fabric by Impregnation with PVA with a High Degree of Saponification

Example 1.1

Impregnation with PVA (Step b) and Subsequent Removal of the Sea Component (Step c)

The intermediate "felt F2" product undergoes dimensional shrinkage by spending 5 minutes in a solution containing 11.6% PVA with a high degree of saponification (98%), at a temperature of 98° C., and it is dried in an oven at a temperature of 190° C. for a period of time sufficient to permit both removal of the water and the consequent thermal curing step. The oven speed is regulated in such a manner that the temperature of the dried bolt is maintained at 190° C. for 3 minutes and the bolt exhibits slight browning at the exit thereof. In the next step, removal of the sea component is carried out through an alkali treatment with 5% caustic soda at a temperature of 60° C. for 15 minutes, in a vibro washer. Using an electron microscope, cross analyses of the removal of the sea component and loss in weight lead to the conclusion that the removal of the sea component is complete and that under these conditions, all the PVA is still present. The bolt thus reinforced contains 28% PVA by weight and is identified as intermediate product "SRCD1".

Example 1.1.a

Fibre Obtained with a Sea Component Coextruded with PEG, at a Removal Temperature of 60° C.

The intermediate "felt F1" product undergoes dimensional shrinkage by spending 5 minutes in a solution containing 11.6% PVA with a high degree of saponification, at a temperature of 99° C., and it is dried in an oven at a temperature of 190° C. for a period of time sufficient to permit both removal of the water and the consequent thermal curing step. The oven speed is regulated in such a manner that the bolt exhibits browning that is not excessive at the exit thereof. In the next step, removal of the sea component is carried out through an alkali treatment with 5% caustic soda at a temperature of 60° C. for 15 minutes, in a vibro washer. Using an electron microscope, analyses show effective removal of the sea component and that the PVA is still present, whereas the assessments of variations in weight lead to the conclusion that the PVA has not been solubilized under the dissolution conditions.

The bolt thus reinforced contains 28% PVA by weight and is identified as intermediate product "SRCD2".

Example 1.1.b

Fibre Obtained with a Sea Component Coextruded with PEG, at a Removal Temperature of 70° C.

This example differs from example 1.1.a only in that the dissolution temperature of the sea component is increased to 70° C., so as to attempt to accelerate the process. Using an electron microscope, analyses show more effective removal of the sea component and that the PVA is still present, whereas the assessments of variations in weight lead to the conclusion that the PVA has not been solubilized under the dissolution conditions. The bolt thus reinforced contains 28% PVA by weight and is identified as intermediate product "SRCD3".

Example 1.1.b1 (Comparative)

Fibre Obtained with a Sea Component

Coextruded with PEG, at a Removal Temperature of 80° C. This example differs from example 1.1.a only in that the dissolution temperature of the sea component is increased to 80° C., so as to attempt to accelerate the process further. Using an electron microscope, analyses show that removal of the sea component is complete; the PVA is still present, but the assessments of the variation in weight lead to the conclusion that a part thereof has been removed. The bolt thus reinforced contains 13% PVA by weight and is identified as intermediate product "SRCD3/1". Owing to the loss of PVA, this intermediate product cannot be utilized in the subsequent steps.

Example 1.1c

The intermediate "felt F4" product undergoes dimensional shrinkage by spending 5 minutes in an 11.6% PVA solution with a high degree of saponification, and it is dried in an oven at a temperature of 190° C. for a period of time sufficient to permit both removal of the water and the consequent thermal curing step. In the next step, removal of the sea component is carried out through an alkali treatment with 5% caustic soda at a temperature of 60° C. for 15 minutes, in a vibro washer. The bolt thus reinforced contains 31% PVA by weight and is identified as "SRCD4".

Example 1.2

Impregnation with PU and Hot Air Coagulation

The microfibrous intermediate SRCD1 product of example 1.1 is impregnated with an aqueous dispersion containing $CaCl_2$ and an emulsion of polyurethane, a thickener and silicone. Specifically, the UX660-X12 polyurethane (aliphatic, anionic, polycarbonate-based PUD, produced by Sanyo Chemicals) constitutes 20.2% by weight of the dispersion, the TAFIGEL PUR 41 thickener (polyurethane-based, nonionic surfactants, produced by Munzing GmBH) constitutes 1.1%, the Silicon A silicone (proprietary formulation, supplied by Sanyo Chemicals), constitutes 1.1% and $CaCl_2$ salt, 1%. The preparation has a viscosity of 343 cP and a coagulation temperature of 58° C. (known as the Cloud Point).

The emulsion is coagulated on the impregnated microfibrous intermediate product by setting it in a pin oven at temperatures increasing from 85° C. to 130° C. until the complete drying thereof. The temperature gradient prevents the water from evaporating so rapidly that even the solid part of the dispersion is transported towards the surface, before it receives sufficient heat to break down the surfactants that keep the PUD in suspension. The barrier effect of the PVA present on the edges acts in such a manner that most of the PUD proves to be distributed in the centre of the composite material.

At this point, the PVA is removed from the intermediate product in a vibro washer at a temperature of 95° C. and the remaining bolt is dried. The PUD/PET ratio of the intermediate product thus produced is 51.2% and the bolt takes the name "IE1".

Example 1.2a

Impregnation with PU Containing a Cross-Linking Agent and Hot Air Coagulation

The intermediate PET and PVA product identified as "SRCD3" and obtained in example 1.1.b is impregnated with an aqueous dispersion containing emulsions of DLU polyurethane, a thickener and a cross-linking agent. Specifically, the DLU polyurethane (aliphatic, anionic, polyether/polycarbonate-based PUD, produced by Bayer) constitutes 17% by weight of the dispersion, the TAFIGEL PUR 44 thickener constitutes 1.1% and the IMPRAFIX 2794 cross-linker (blocked aliphatic isocyanate, with an unblocking temperature of about 120° C., produced by Bayer) constitutes 0.8%. The formulation thus obtained has a viscosity of 568 cP and a Cloud Point of 92° C. The emulsion is coagulated on the impregnated microfibrous intermediate product by setting it in a pin oven for 15 minutes at temperatures increasing from 85° C. to 150° C. until the complete drying in the first zones, and maintaining this latter temperature in the last zones of the oven so as to ensure activation of the cross-linking agent. The barrier effect of the PVA present on the edges acts in such a manner that most of the PUD proves to be distributed in the centre of the composite material.

The PVA is removed from the intermediate product by washing it in a vibro washer with water heated to a temperature of 95° C. The PUD/PET ratio in the intermediate product is 40.2% and the bolt takes the name "IE1.a".

Example 1.2b

Impregnation with PU Containing a Cross-Linking Agent and Hot-Air Coagulation

The microfibrous SRCD4 felt of example 1.1c is impregnated and coagulated using the same solution and the same means specified in example 1.2a. The intermediate product thus obtained has a PU/PET ratio of 51.5%, a thickness of 1.51 mm and takes the name "IE1.b".

Example 1.3

Impregnation with PU and Hot Water Coagulation in the Presence of Salts

The microfibrous intermediate SRCD1 product obtained in example 1.1 is impregnated with an aqueous dispersion containing emulsions of polyurethane and a thickener. Unlike example 1.2, in this case silicone and $CaCl_2$ are not used in the emulsion.

Specifically, the UX660-X12 polyurethane (aliphatic, anionic, polycarbonate-based PUD, produced by Sanyo Chemicals) constitutes 27% by weight of the dispersion, and the TAFIGEL PUR 41 thickener (polyurethane-based, nonionic surfactants, produced by Munzing GmBH) constitutes 0.55%. The preparation has a viscosity of 524 cP and a coagulation temperature of 69° C. The impregnated bolt spends 24 minutes in a tank containing water and 0.5% $CaCl_2$ by weight, at a temperature of 80° C. At this point, the PVA is removed from the intermediate product in a vibro washer at a temperature of 95° C. and the remaining bolt is dried. The PUD/PET ratio of the intermediate product thus produced is 50.3% and the bolt takes the name "IE2".

Example 1.4

Impregnation with PU and Radiofrequency Coagulation

The microfibrous intermediate SRCD1 product of example 1.1 is impregnated with an aqueous dispersion containing emulsions of polyurethane, a thickening agent and silicone. Specifically, the UX660-X12 polyurethane (aliphatic, anionic, polycarbonate-based PUD, produced by Sanyo Chemicals) constitutes 20.2% by weight of the dispersion, the TAFIGEL PUR 41 thickener (polyurethane-based, nonionic surfactants, produced by Munzing GmBH) constitutes 1.1% and Silicon A silicone (proprietary formulation, supplied by Sanyo Chemicals) constitutes 1%. The formulation thus obtained has a viscosity of 332 cP and a mean Cloud Point of 75° C. Following impregnation, the polyurethane coagulates in 2 minutes in a radiofrequency oven with a parallel field, in which the applied voltage is 0.5 kV; at the oven exit, the bolt exhibits residual moisture, but complete coagulation has taken place. It is not necessary to bring the material to a dried state before the dissolution of the PVA. At this point, the PVA is removed from the intermediate product in a vibro washer at a temperature of 95° C. and the remaining bolt is dried. The PUD/PET ratio of the intermediate product thus produced is 52.7% and the bolt takes the name "IE3"

Example 1.4a

Impregnation with PU and RF Coagulation on an Intermediate Product of Thin Thickness The microfibrous SRCD4 felt of example 1.1c is impregnated and coagulated using the same solution and the same means specified in example 1.4. The intermediate product thus produced has a PU/PET ratio of 54.8%, a thickness of 1.52 mm and it takes the name "IE4".

Example 2

Preparation of a Non-Woven Fabric by Impregnation With PU

Example 2.1

Impregnation with PU (Step b) and Subsequent Removal of the Sea Component (Step c)

The F2 felt obtained in example 0.2 is immersed in hot water at a temperature of 95° C. for 5 minutes and dried in a convection oven at a temperature of 130° C., thereby raising the final total density to 0.39 g/cm$^3$.

A dispersion is prepared separately containing 6.6% WITCOBOND 279-34 polyurethane (aliphatic, anionic, polyether-based PUD, produced by Baxenden Chemicals) and VISCOTAN SY thickener in the amount of 7% with respect to the dry polyurethane, so that the final viscosity reaches 180 cP. The felt is impregnated with the polyurethane dispersion at ambient temperature, metered with a squeeze roll, immersed for 23 minutes in a tank of 5% acetic acid at 35° C., washed in a vibro washer with water to bring the pH of the bolt to neutral levels, and then dried in an oven at 150° C. In the oven, the bolt first undergoes evaporation of the water and then thermal curing. In the next step, removal of the sea component is carried out through an alkali treatment with 5% caustic soda at a temperature of 60° C. for 15 minutes, in a vibro washer. Using an electron microscope, analyses show effective removal of the sea component, supported by the assessments of weight loss. The bolt thus reinforced contains 9.2% polyurethane by weight and is identified as "SRCD5".

Example 2.2

Impregnation with PU and Hot Air Coagulation

A sample is taken of the intermediate SRCD5 product obtained in example 2.1 and it is impregnated with an aqueous dispersion containing $CaCl_2$ and emulsions of polyurethane, thickener and silicone. Specifically, the UX660-X12 polyurethane (aliphatic, anionic, polycarbonate-based PUD, produced by Sanyo Chemicals) constitutes 20.2% by weight of the dispersion, the TAFIGEL PUR 44 thickener (polyurethane-based, nonionic surfactants, produced by Munzing GmBH) constitutes 1.1%, the Silicon A silicone (proprietary formulation, supplied by Sanyo Chemicals) constitutes 1.1% and $CaCl_2$ salt, 1%. The emulsion is coagulated on the bolt by setting the latter in a pin oven at a temperature of 130° C. until the complete drying thereof. The mixture of emulsions is metered on the bolt in such a manner as to bring the polyurethanes/PET ratio to 50%, where polyurethanes are intended as the sum of the polyurethane already present on the intermediate SRCD5 product and the amount of polyurethane remaining after coagulation of the emulsion described hereinabove. The bolt obtained has a polyurethanes/PET ratio of 58.2% and it is identified as "IE5".

Example 2.3

Impregnation with PU and Radiofrequency Coagulation

One proceeds as in example 2.2, bringing the Sanyo PUD to a concentration of 27% and eliminating the calcium salt, but leaving the proportions of thickener and silicone unchanged. The formulation thus obtained has a viscosity of 580 cP. Following impregnation and metering, the polyurethane coagulates in 2 minutes in a radiofrequency oven with a parallel field, in which the applied voltage is 0.5 kV. The bolt obtained has a polyurethanes/PET ratio of 49.0% and is identified as "IE6".

Example 2.4

Impregnation with PU and Hot Water Coagulation

One proceeds as in example 2.3, eliminating the silicone from the impregnation dispersion. The formulation thus obtained has a viscosity of 800 cP. Following impregnation and metering, the polyurethane coagulates in 24 minutes in water containing 5% $CaCl_2$ at a temperature of 40° C. The bolt obtained has a polyurethanes/PET ratio of 45.9% and is identified as "IE7".

Example 3

Finishing Processes

Example 3.1

Finishing Process of the Impregnated Intermediate Product

The impregnated microfibrous felt with one of the types of coagulation described hereinabove (examples 1.2, 1.2a, 1.2b, 1.3, 1.4, 1.4a, 2.2, 2.3 and 2.4) is emerised on both sides so as to confer uniform direction and length to the nap, removing 0.25 mm on each side, using papers of a fineness varying between 150 and 220 mesh and dyeing in jets at 120° C. with a mixture of disperse dyes.

It is only after dyeing that the bolt is split longitudinally exactly in half along the direction of the thickness thereof, with a maximum tolerance of 0.05 mm.

The final thickness varies between 0.73 and 1.01 mm.

It is possible to obtain a final product of a thickness of 0.54 mm only in the case of bolt 1.4a.

The polyurethane, applied by means of a hot-air coagulation process, proves to be transparent only in the case of bolt 1.2b; this makes it possible to prevent the presence of specking on the dyed product.

Example 3.2 (Comparative)

An impregnated intermediate product deprived of the PVA is realized as in example 1.4a. Unlike the latter example, in this case the bolt is first split longitudinally exactly in half along the direction of the thickness thereof, and then emersed. A total of 0.04 mm is removed from the sides in contact with the blade and another 0.25 mm is removed from the remaining sides. The bolt is then dyed in jets at 120° C. with a mixture of disperse dyes.

The bolt does not exhibit tenacity sufficient to complete the dyeing cycle without damage.

Example 3.3

Disperse and Vat Dye Dyeing

The microfibrous intermediate "IE3" product (impregnated with polyurethane in water and coagulated in a radiofrequency oven) is emersed on both sides so as to confer uniform direction and length to the nap, removing 0.25 mm on each side, using papers of a fineness varying between 150 and 220 mesh. The bolt thus emersed is dyed in dyeing jets in two successive steps: the first step at 120° C. with disperse dyes so as to confer colour to the fibre and the next step at 80° C. with vat dyes to confer colour to the polyurethane.

At the end of the dyeing step, the intermediate product is split longitudinally exactly in half along the direction of the thickness thereof, with a maximum tolerance of 0.05 mm.

Owing to the colouring of the polyurethane, the appearance of the bolt is more uniform, compared to the counterpart obtained solely by colouring with disperse dyes.

Example 3.4

Disperse and Cationic Dye Dyeing on Dual Impregnation

The microfibrous intermediate "IE4" product is emersed on both sides so as to confer uniform direction and length to the nap, removing 0.25 mm on each side, using papers of a fineness varying between 150 and 220 mesh. The bolt thus emersed is dyed in dyeing jets in two successive steps: the first step at 120° C. with disperse dyes so as to confer colour to the fibre and the next step at 80° C. with cationic dyes to confer colour to the polyurethane.

At the end of the dyeing step, the intermediate product is split longitudinally exactly in half along the direction of the thickness thereof, with a maximum tolerance of 0.03 mm.

Owing to the colouring of the polyurethane, the appearance of the bolt is more uniform, compared to the counterpart obtained solely by colouring with disperse dyes.

The invention claimed is:

1. A process for the preparation of a microfibrous nonwoven fabric, comprising the steps of:

a. preparing a felt via needle punching of a bicomponent fibre of the "island-in-the-sea" type, b. hot impregnation of said felt with an aqueous solution of polyvinyl alcohol (PVA) having a degree of saponification of at least 94%, or hot impregnation of said felt with water and then cold impregnation with polyurethane (PU), c. removal of the sea component from the intermediate product of step b, d. impregnation of the microfibrous intermediate product with PU, e. fixing the PU to the microfibrous intermediate product by means of coagulation and removing the PVA possibly added in step b, f. submitting the material thus obtained to immersing on one or both sides, dyeing and splitting carried out in the order specified.

2. The process according to claim 1, wherein step b is carried out by impregnation with an aqueous solution of PVA at a temperature of at least 50° C.

3. The process according to claim 1, wherein step b is carried out by impregnation with PU in an aqueous medium at a temperature no higher than 50° C.

4. The process according to claim 1, wherein the PVA in step b has a degree of saponification of at least 94%.

5. The process according to claim 1, wherein in step b the PU is present in an aqueous medium and the coagulation of the PU takes place in water containing electrolytes or acids, in hot water or by means of radiofrequency or steam coagulation.

6. The process according to claim 1, wherein step c for removal of the "sea" component takes place by means of contact of the intermediate product, as obtained in step b, with a basic aqueous solution of an alkaline or alkaline earth hydroxide.

7. The process according to claim 1, wherein step c for removal of the "sea" component takes place at a temperature of less than 80° C., in the case in which step b is carried out with PVA.

8. The process according to claim 1, wherein step d for impregnation is carried out with PU in an aqueous medium in the presence of one or more among: emulsifiers, cross-linking agents, thickeners, surfactants, viscosity regulators, destabilizing agents, salts of alkali metals or of alkaline earth metals and external silicone derivatives.

9. The process according to claim 1, wherein step d is carried out by means of impregnation with PU in an aqueous medium, and step e is carried out by means of coagulation in hot water, in water containing electrolytes or acids, in hot air or by means of radiofrequency, microwave or steam coagulation.

10. The process according to claim 9, wherein step d is carried out by means of impregnation with PU in an aqueous medium, and step e is carried out by means of coagulation in an aqueous solution at a temperature ranging between 20 and 90° C.

11. The process according to claim 9, wherein step e is carried out by means of coagulation in an aqueous solution containing a salt in amounts within the range of 0.01% to 5% by weight.

12. The process according to claim 9, wherein step d is carried out by means of impregnation with PU in an aqueous medium, and step e is carried out by means of coagulation in hot air at a temperature ranging between 50° C. and 200° C.

13. The process according to claim 9, wherein step d is carried out by means of impregnation with PU in an aqueous medium, and step e is carried out by means of coagulation in a radiofrequency oven with a parallel or oblique field and a voltage between the electrodes ranging between 0.1 kV and 6 kV.

14. The process according to claim 13, wherein step e is carried out by means of coagulation in a radiofrequency oven with a parallel field and a voltage between the electrodes ranging between 0.3 kV and 5 kV.

15. The process according to claim 1, wherein step d is carried out by means of impregnation with an organic solution of PU, and step e is carried out by means of coagulation in water or a mixture of water and an organic solvent.

16. The process according to claim 15, wherein the solvent of said organic solution is selected from among DMF and DMAC with a solvent/water ratio ranging between 0/100 and 50/50.

17. The process according to claim 1, wherein the felt is prepared via needle punching of a bicomponent fibre of the "island-in-the-sea" type, wherein the island component is selected from a group consisting in: modified polyesters, cationic polyesters, nylon or other types of polyamides, polyethylene, polypropylene, polymethylene terephthalate (PTT), polybutylene terephthalate (PBT) and polyethylene terephthalate (PET).

18. The process according to claim 1, wherein the felt is prepared via needle punching of a bicomponent fibre of the "island-in-the-sea" type, wherein the sea component is selected from among: polyvinyl alcohol (PVA), polystyrene copolymers containing PVA (co-PVA-PS), copolyesters containing PVA (co-PVA-PES) and copolyester containing 5-sulfoisophthalic acid or the sodium salt thereof (co-PES).

19. A non-woven microfibrous suede-like synthetic fabric obtained with the process according to claim 1, wherein said fabric has a thickness of less than 0.7 mm.

20. The process according to claim 1, wherein the material yielded by the process is a microfibrous non-woven fabric having a thickness of less than 0.7 mm.

* * * * *